US005400011A

United States Patent [19]

Sutton

[11] Patent Number: 5,400,011

[45] Date of Patent: Mar. 21, 1995

[54] METHOD AND APPARATUS FOR ENHANCING REMOTE AUDIO MONITORING IN SECURITY SYSTEMS

[75] Inventor: Gary E. Sutton, La Jolla, Calif.

[73] Assignee: Knight Protective Industries, Inc., North Hollywood, Calif.

[21] Appl. No.: 184,199

[22] Filed: Jan. 18, 1994

[51] Int. Cl.[6] ..... G08B 13/22

[52] U.S. Cl. ..... 340/566; 340/691; 340/692; 340/825.15; 340/825.49

[58] Field of Search ..... 340/566, 691, 692, 825.15, 340/825.49, 825.36

[56] References Cited

U.S. PATENT DOCUMENTS

| | | | |
|---|---|---|---|
| 3,233,232 | 2/1966 | Brennon | 340/691 |
| 3,705,401 | 12/1972 | Scott | 340/691 |
| 3,974,489 | 8/1976 | Bleeker et al. | 340/566 |
| 4,633,234 | 12/1986 | Gagnon | 340/566 |

*Primary Examiner*—Glen Swann
*Attorney, Agent, or Firm*—Brown, Martin, Haller & McClain

[57] ABSTRACT

A remotely-monitored stored-audio security system has a local control unit at a monitored premises that communicates with a remotely located central control unit for alerting personnel of an alarm at the premises. Microphones located on the monitored premises receive sounds that are recorded on a recording device in the local control unit. When the alarm occurs the recording device ceases recording, thereby preserving any sounds that occurred prior to and immediately after the activation of the security system. A detector monitors the input to the recording device and detects the occurrence of a discrete sound, i.e., a sound exceeding the level of ambient noise. When the local control unit transmits the alarm indication it also transmits an indication to the central control unit for informing personnel whether any discrete sounds have been recorded. Personnel at the monitoring center can then enter commands on a console to receive live audio detected by a microphone in real-time or play back and receive recorded audio. Personnel may also receive a mix of audio from both sources. The audio played back by the recording device may be transmitted to the central control unit in a compressed format to reduce transmission time. The central control unit may have a similar recording device for recording transmitted audio.

22 Claims, 2 Drawing Sheets

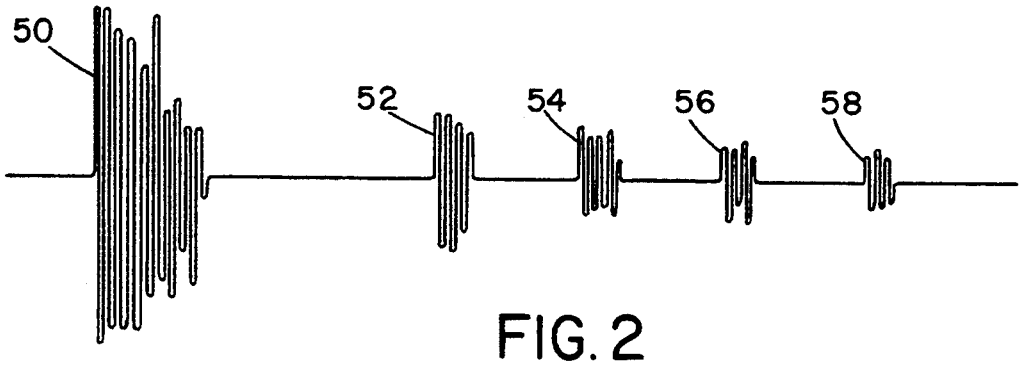
FIG. 2
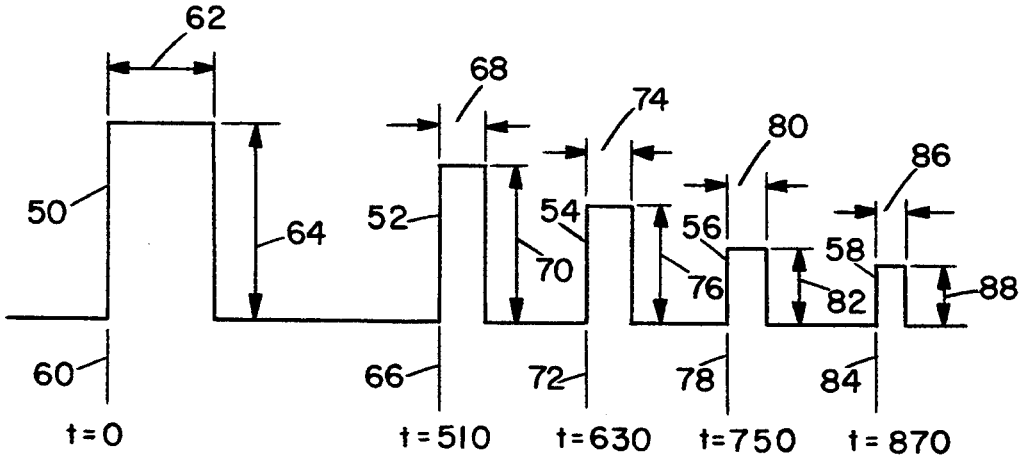
FIG. 3
| SOUND NO. | MIC NO. | START ADDR. | LENGTH | LEVEL |
|---|---|---|---|---|
| 1 | 1 | 0000 | 60 | 10 |
| 2 | 1 | 0510 | 20 | 8 |
| 3 | 1 | 0630 | 20 | 6 |
| 4 | 1 | 0750 | 20 | 4 |
| 5 | 1 | 0870 | 20 | 3 |
FIG. 4

METHOD AND APPARATUS FOR ENHANCING REMOTE AUDIO MONITORING IN SECURITY SYSTEMS

BACKGROUND OF THE INVENTION

The present invention relates generally to remotely monitored security systems that have audio information gathering capability and, more particularly, to a device and method for enhancing the effectiveness of security systems that record audio information at the monitored premises.

A security system located on the site of a structure to be monitored typically consists of a local control unit connected to one or more detectors placed at strategic points in the structure. The detectors may include contact switches, pressure switches, infrared sensors, ultrasonic sensors, smoke or fire detectors, or any of the types that are commonly used in security systems. In addition, some security systems, known as emergency response systems, have a manually operated transmitter that an elderly or infirm person can use to activate the security system.

Upon the occurrence of an event such as the opening of a door or window or the activation of an emergency response transmitter, the security system alerts personnel at a monitoring center located at a remote site. The personnel at the monitoring center can then respond to the situation. Such action typically includes dispatching security personnel or police to the premises.

False alarms are a serious problem in security systems. Not only does dispatching security personnel or police in response to a false alarm waste resources, but in many communities it subjects property owners to fines if police are repeatedly summoned. To avoid such problems, security systems may transmit additional information following the initial notification to aid monitoring personnel in distinguishing false alarms from alarms occurring in response to actual events that the security system is intended to detect. For example, a security system may transmit information identifying the premises and the type and location of the particular detector that triggered the alarm.

The additional information transmitted to monitoring personnel may also include sounds occurring at the premises immediately preceding or following the initial notification. A security system may have one or more microphones placed at strategic locations in the structure. Via the telephone connection or radio link established by the activation of the alarm, monitoring personnel can listen to sounds on the premises or, in some systems, speak to those on the premises. The latter allows the verification of the alarm situation through a verbal challenge to the occupants of the structure. Should the alarm activation be confirmed as harmless, the response protocol could be terminated at a relatively early stage without the unnecessary expenditure of scarce resources. The use of such a system also allows remote personnel to deduce the exact nature of a manually-activated alarm and tailor their actions accordingly.

Security systems that allow monitoring personnel to hear sounds occurring at the premises have been improved by including audio recording or storage devices at the monitored premises for storing any sounds that may have occurred prior to or following the activation of the alarm. Such "stored-audio" systems commonly have a continuous-loop audio tape as a storage medium located on the monitored premises. The security system continuously records ambient sound until the alarm is activated. Via the telephone connection or radio link established by the activation of the alarm, monitoring personnel can play back the recorded sounds. Stored-audio systems may allow monitoring personnel to remotely select either the stored audio or the "live" audio captured in real-time by the microphones.

Responding to the activation of a stored-audio security system presents monitoring personnel with a dilemma. If they select the stored audio they may miss critical sounds occurring at the premises, such as a cry for help, while they are listening to the stored audio. If they select the live audio they may miss sounds that occurred prior to the activation of the alarm, such as the sound of shattering glass. It would be desirable to provide monitoring personnel with an indication of whether any sound information has been recorded that has a quality or length sufficient to aid personnel in identifying the source of the sounds. These problems and deficiencies are clearly felt in the art and are solved by the present invention in the manner described below.

SUMMARY OF THE INVENTION

The present invention comprises a remotely-monitored stored-audio security system-having one or more detectors, which detect events occurring at the monitored premises such as the presence of an intruder or the opening of a door or window, one or more microphones located on the monitored premises, a means for recording audible sounds detected by the microphones, and a local control unit for transmitting to monitoring personnel both an indication that an event has occurred and an indication that the recording means has recorded sound information. The invention further comprises a central control unit located at the central monitoring station.

The microphones are connected to the recording means, which continuously records ambient sound. The recording means stores the audio information in any suitable digital or analog format and may use any suitable recording medium such as semiconductor memory, disk, or analog or digital tape.

Suitable detectors include any type of detector commonly used in security systems, such as those using electrical contacts, magnetic switches, infrared sensors or ultrasonic sensors. Suitable detectors also include manually-activated emergency response radio transmitters of the type commonly used by the elderly and infirm to summon help in an emergency. The security system is activated when an event is detected, and the system automatically establishes a communication link with a remote monitoring center. The link may use any suitable communication medium such as telephone or radio.

At approximately the same time that the security system is activated by detection of an event, the recording means ceases recording, thereby preserving on the recording medium any sounds that occurred prior to the activation of the security system. The recording means can record an amount of information that is limited only by the capacity of the recording medium. When the medium is full the recording means begins recording at the beginning of the medium over any previously recorded information.

The local control unit at the premises can receive information from the central control unit at the monitoring center via the communication link as well as transmit information. The received information may include microphone selection information to select a particular microphone in an embodiment having more than one microphone. As described below, the received information includes audio source selection information to select either live audio detected by a microphone, stored audio produced by the recording means or a mix of both. The signal produced by the selected audio source is then transmitted over the communication link to the monitoring center. If stored audio is selected, the stored audio may be transmitted in a compressed form to reduce transmission time.

At the monitored premises, the security system has a detector for discriminating between ambient noise and discrete sounds. The detector continuously monitors the audio information as it is being recorded. When the detector detects a change in a characteristic of the audio, such as an amplitude exceeding a predetermined threshold, it sets an indicator flag within the local control unit, indicating that a discrete sound has occurred. If no sounds have occurred within the period of time corresponding to the maximum capacity of the storage medium, the discriminating means resets the indicator.

When the detector indicates that the amplitude exceeds the noise threshold the local control unit may measure and store in a memory the length of time that each discrete sound persists as well as the lengths of time or gaps between different discrete sounds. In addition, the detector may measure and store in a memory the average amplitude of the discrete sound. In embodiments having multiple microphones, the local control unit may also identify the microphone that is the source of the discrete sound and store an identifying number in a memory.

When the alarm is activated the local control unit transmits an indication to the central control unit for alerting monitoring personnel to any discrete sounds that occurred prior to activation of the alarm. The indication may comprise some or all of the stored information. However, the information should, at a minimum, provide a binary indication of whether or not any sounds have occurred.

Receipt of the indication or the stored information corresponding to the discrete sounds activates an audible or visual indicator at the monitoring center. The indicator, which may be a short audible tone, an indicator lamp, or a graphical display representing some or all of the recorded discrete sounds, thus alerts monitoring personnel that one or more discrete sounds have been recorded. If the system has multiple microphones, the identity of the microphone or microphones that recorded the discrete sounds may also transmitted and displayed.

In response to the visual or audible indicator, monitoring personnel can transmit audio source selection commands to the local control unit, as described above. In response to one such command, the local control unit may transmit the live audio. Monitoring personnel can listen to the live audio and evaluate the situation. In response to another such command, the local control unit transmits stored audio information in compressed form followed by or interleaved with transmission of live audio. In response to a similar command, the stored audio may be transmitted in compressed form, but the occurrence of a live discrete sound during transmission of the compressed stored audio may interrupt the transmission and cause live audio to be transmitted. In response to another command, the local control unit may transmit the stored audio in real-time. In response to still another command, the stored audio may be mixed with live audio as the stored audio is played in real-time and the mixed audio transmitted to the central control unit. If the system includes multiple microphones, commands should designate a particular microphone as the source of the live or stored audio.

In essence, if the visual or audible indicator at the monitoring center is not activated, indicating that no discrete sounds have been recorded, monitoring personnel need not waste critical time by listening to recorded audio that likely contains no sounds related to the occurrence of the event that activated the alarm.

The foregoing, together with other features and advantages of the present invention, will become more apparent when referring to the following specification, claims, and accompanying drawings.

BRIEF DESCRIPTION OF THE DRAWINGS

For a more complete understanding of the present invention, reference is now made to the following detailed description of the embodiments illustrated in the accompanying drawings, wherein:

FIG. 2 illustrates a waveform produced by a microphone in response to several discrete sounds;

FIG. 3 illustrates quantization of the discrete sounds produced by a microphone; and FIG. 4 is a table showing the stored information transmitted by the local control unit to the central control unit upon activation of the alarm.

DESCRIPTION OF THE PREFERRED EMBODIMENT

Figure 1:
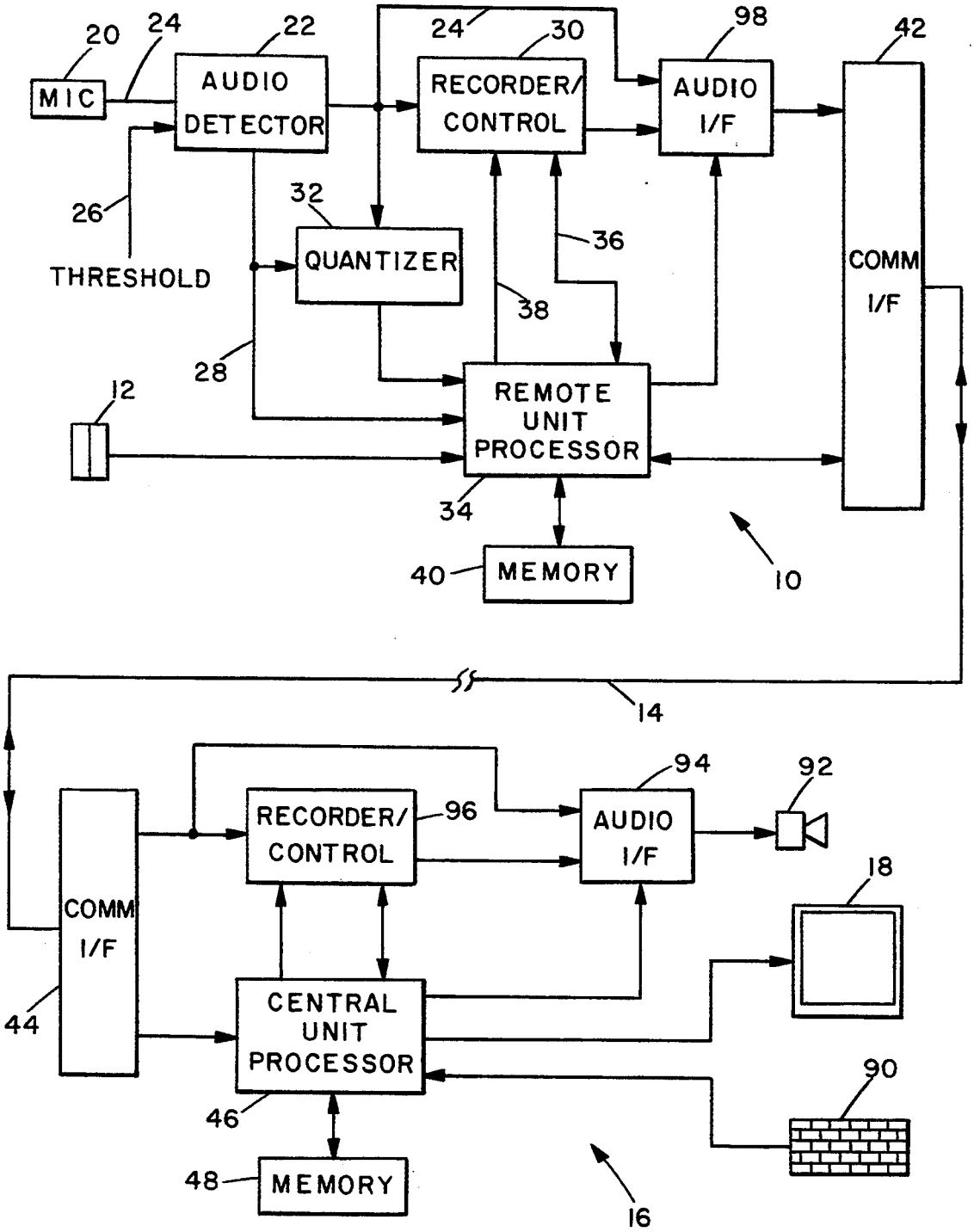
FIG. 1 is a block diagram of an enhanced remotely monitored stored-audio security system.

As illustrated in FIG. 1, a local control unit 10 is connected to a sensor 12 located in a suitable location at a monitored premises (not shown), as known in the art. Sensor 12 may be any type of sensor commonly used in security systems such as a contact switche, magnetic switch, or ultrasonic or infrared sensor. When a sensor is activated local control unit 10 establishes a communication link over the telephone line 14 with a central control unit 16 at a remote monitoring station (not shown) and transmits an alarm indication. Although telephone communication is illustrated, the communication link may be via a hard-wired line, radio, or any other medium commonly used in security systems. Central control unit 16 receives the alarm indication and displays a suitable message on a video monitor 18 to alert monitoring personnel. As known in the art, local control unit 10 may also transmit other information to central control unit 16, such as the type and location of the sensor that was activated.

A microphone 20 is located at a suitable location at the monitored premises. An audio detector 22 receives the audio output 24 of microphone 20 and compares it to a predetermined threshold level 26, which may be set by a potentiometer adjustment or other suitable circuit (not shown). Audio detector 22 compares audio output 24 to threshold level 26, and produces a gate signal 28 if the average amplitude of audio output 24 over a time period of approximately ten to twenty milliseconds (ms) exceeds that of threshold level 26. Audio detector 22 may comprise any suitable circuit known in the art.

A recording means 30 receives audio output 24, which is passed through audio detector 22 without substantial change. Although recording means 30 is preferably a digital audio sampling circuit that uses an analog-to-digital converter to convert the sound to digital data and stores it in semiconductor memory for subsequent playback via a digital-to-analog converter, any type of recorder that can access any point on a 90 second section of its recording medium in less than about ten seconds is suitable, including analog or digital audiotape. Suitable circuits for digitally recording and playing sound are well-known. In addition to circuits that use a digital storage medium, integrated circuit chips that use a transistor array to store analog signals directly, such as the ISD 10XX family of products produced by Information Storage Devices, Inc. of San Jose, Cal., are also suitable. Like digital sampling devices, such chips have an address bus for randomly accessing areas of the recording medium. Chips may be cascaded for longer total recording times.

In the preferred embodiment, when recording means 30 reaches the end of its memory, it begins recording at the beginning of its memory in a continuous-loop fashion, thereby overwriting any information that was previously stored there.

A quantizer 32 receives audio output 24 and measures the average amplitude over the period during which gate signal 28 indicates that a discrete sound is occurring. Although quantizer 32 may measure this amplitude to within any suitable resolution, a range between one and 16 provides a preferred representation of the amplitude. Quantizer 32 may comprise any suitable analog or digital circuitry.

Local control unit 10 has a processor 34, which may be any suitable type of microprocessor or discrete circuitry. Processor 34 receives the memory address at which recording means 30 is recording via a bidirectional address bus 36 and provides commands to control the operation of recording means 30 via a control bus 38. For example, processor 34 can command recording means 30 to play stored audio or record audio beginning at the address that processor 34 places on address bus 36. Recording means 30 increments (or decrements) both its internal address and that on address bus 36 as it plays or records audio. The rate at which the address is advanced depends on the sampling rate. In response to activation of sensor 12, processor 34 commands recording means 30 to stop recording.

Processor 34 also receives the output of quantizer 32, which represents the average amplitude of a discrete sound, and stores it in a memory 40. Memory 40 may also be used for storing software instructions for processor 34. Processor 34 monitors the address on address bus 36 produced by recording means 30 as it records audio and stores the address that is present at the time a discrete sound begins. Processor 34 also stores the difference between the address present at the time the discrete sound begins and the address present at the time the discrete sound ends. This difference represents the duration of the discrete sound.

In response to activation of sensor 12, processor 34 initiates a telephone call to the central monitoring station via telephone line 14. A communications interface 42 dials the call and formats the information received from processor 34 into a series of modulated tones according to a suitable predetermined protocol. The modulation may be frequency-shift keying (FSK), phase-shift keying (PSK), or any other method known in the art for modulating and demodulating data to be transmitted over telephone lines.

A corresponding communications interface 44 in central control unit 16 answers the call. Communication interface 44 demodulates the information and provides it to a central control unit processor 46, which interprets the information. Processor 46 is connected to a memory 48 for storing software instructions and other data. In this manner, local control unit 10 establishes a communication link with central control unit 16. Local control unit 10 then transmits an initial indication that the alarm has been activated in order to alert monitoring personnel. It may also transmit other important information such as the address of the premises, name of the owner, and the number and type of sensors and microphones and their location on the premises.

As illustrated in FIG. 2, a waveform representing an exemplary audio output 24 has five discrete sounds 50, 52, 54, 56, and 58. For example, sound 50 may represent the shattering of a window and may have a duration of approximately 60 ms. Following sound 50 is a gap of approximately 450 ms. Sounds 52, 54, 56, and 58 may, for example, represent a series of four footsteps running away from the premises. The footsteps are each approximately 20 ms in duration and are separated by gaps of approximately 100 ms.

As illustrated in FIGS. 3–4, sound 50 starts at time 60, which coincides with the presence of an address on address bus 36. Processor 34 stores this address or an value derived from it in memory 40. For illustrative purposes, the stored addresses in this example equal the elapsed time in milliseconds from the starting time (t=0) for sound 50. However, the actual correspondence between address and time depends upon the type of recording means 30, the sampling rate, and other factors that will be readily apparent to persons skilled in the art.

Processor 34 also measures and stores the duration 62 of sound 50 in memory 40. In this example duration 62 is 60 ms. In addition, processor 34 stores the output of quantizer 32, which in this example is an average amplitude 64 of 10. Processor 64 may also store a number identifying the microphone that produced the sound, which in this example is designated 1. Processor 34 organizes this information into a "sound map" in memory 40, as shown in FIG. 4. The stored information corresponding to sound 50 is labeled sound number 1, and subsequent sounds are labeled with consecutive sound numbers. Although these sound numbers are chosen arbitrarily for illustrative purposes in this example, they may correspond to address locations of memory 40 in which the sound map information is stored.

When sound 52 occurs at time 66 processor 34 stores an address, which has a value of 510, a duration 68, which has a value of 20, an amplitude 70, which has a value of 8, and a microphone number having a value of 1. Similarly, when sound 54 occurs at time 72 processor 34 stores an address, which has a value of 630, a duration 74, which has a value of 20, an amplitude 76, which has a value of 6, and a microphone number having a value of 1. When sound 56 occurs at time 78 processor 34 stores an address, which has a value of 750, a duration 80, which has a value of 20, an amplitude 82, which has a value of 4, and a microphone number having a value of 1. Finally, at time 84, processor 34 stores an address, which has a value of 870, a duration 86, which has a value of 20, an amplitude 88, which has a value of 3, and a microphone number having a value of 1.

After local control unit 10 has established a communication link and transmitted any preliminary information regarding the premises and the alarm system, it transmits an indication if one or more discrete sounds have been recorded. The indication preferably comprises the information contained in the sound map, but may comprise only a subset of this information. For example, the indication may consist of a value equal to the number of discrete sounds recorded. The minimum suitable indication is a value having one of two states to indicate either that at least one sound has been recorded or that no sounds have been recorded.

Central unit processor 46 receives the transmitted indication, which in this exemplary embodiment is the information contained in sound map 40, and stores it in memory 48. Processor 46 then alerts monitoring personnel, preferably by generating a graphical representation of information contained in sound map 40 on video monitor 18. The graphical representation is preferably similar to the waveform shown in FIG. 3. However, processor 46 may alert monitoring personnel by generating numerical or alphanumeric information on video monitor 18 or by generating a short audible tone. Monitoring personnel may interpret these graphical or audible indications to determine the type of event that may have triggered the alarm.

Monitoring personnel may then enter commands on a keyboard 90 that are transmitted to local control unit 10. To transmit these commands, central unit processor 46 and communication interface 44 generate sequences of audio tones in a manner similar to that used by local control unit 10 to transmit data to central control unit 16. Commands may be entered in any order and at any time after a communication link has been established. The commands described herein are illustrative of the many suitable commands that may be defined and implemented in software by persons skilled in the art. Although commands are provided with descriptive names in this example, commands are preferably assigned to a pushbutton on a control panel or to softkeys of keyboard 90.

In response to the commands, local control unit 10 may transmit stored or live audio information to central control unit 16, which may provide the audio information to a speaker 92. Speaker 92 may be the speaker of a telephone receiver or may be a stand-alone speaker. While waiting for an initial command to be entered, local control unit 10 preferably transmits live audio to central control unit 16, which reproduces any live sounds on speaker 92.

As described above, some embodiments of the present invention may include multiple microphones located in different areas at the premises. In response to a "SELECT_MIKE" command, remote unit processor 34 selects a source microphone for any subsequently transmitted audio. In the example described above with respect to FIGS. 2–4, an operator would enter the numeral "1" and press a function key or button to which the command "SELECT_MIKE" is assigned because all of the stored sounds were produced by microphone number 1.

Monitoring personnel may wish to listen to sounds in real-time, i.e., occurring live at the premises. In response to a "TRANSMIT_LIVE_AUDIO" command, local control unit 10 transmits the output of the selected microphone to central control unit 16. Remote unit processor 34 controls an audio interface 98 that comprises a switch (not shown). Processor 34 causes audio interface 98 to route the output of the selected microphone to communication interface 42. The audio is transmitted from communication interface 42 of local control unit 10 to communication interface 44 of central control unit 16 via telephone line 14. Central unit processor 46 controls an audio interface 94, which connects the output of communication interface 44 to speaker 92. Monitoring personnel would typically select this command if they receive no indication that any sounds have been stored. Monitoring personnel can listen to sounds occurring live in the vicinity of other microphones, if any, on the premises by entering further "SELECT_MIKE" commands.

Monitoring personnel can also listen to the stored audio. In response to a "TRANSMIT_STORED_AUDIO" command, the contents of recording means 30 are played and transmitted to central control unit 16, which reproduces the transmitted audio on speaker 92. If sounds produced by multiple microphones have been recorded, remote unit processor 34 plays only those produced by the selected microphone. Processor 34 causes stored sounds produced by a selected microphone to be played by placing addresses obtained from the audio map on address bus 36 and then commanding recording means 30 to play stored audio. Thus, personnel can listen to recorded sounds produced by different microphones by entering further "SELECT_MIKE" commands.

A similar command, "TRANSMIT_STORED_AUDIO_OVERRIDE" allows monitoring personnel to listen to the stored audio, but automatically executes a "TRANSMIT_LIVE_AUDIO" command when remote unit processor 34 detects a sound occurring during transmission of the stored audio. Thus, playback of the stored audio is interrupted and substituted with live audio.

Monitoring personnel may retrieve the stored audio but listen only to the live audio. For example, a first operator could listen to the live audio while a second operator listens to the stored audio. In response to a "TRANSMIT_STORED_AUDIO_COMPRESSED" command, the contents of the sound map are transmitted to central control unit 16. The contents of recording means 30 are then played and transmitted to central control unit 16. However, processor 34 uses the sound map information to command recording means 30 to skip over the gaps between sounds. Central unit processor 46 commands a recording means 96, which is similar to recording means 30, to store the received audio. Using the sound map information, processor 46 stores the received sounds between gaps of the length specified in the sound map. Thus, the contents of recording means 30 are copied into recording means 96 in less time than would be required if recording means 30 were played back in real-time. When the stored audio has been copied processor 34 automatically executes a "TRANSMIT_LIVE_AUDIO" command. Personnel may at any time interrupt the live audio and listen to the sounds stored in recording means 96 by executing suitable commands. In addition, monitoring personnel may transfer the contents of recording means 96 to other audio recording media for further analysis or play it back on a second speaker (not shown) without interrupting the live audio.

Monitoring personnel may listen to a mixture of both live audio and stored audio. In response to a "TRANSMIT_MIXED_AUDIO" command, local control unit 10 mixes live audio and stored audio and transmits the mixed audio to central control unit 16. Audio interface 98, which is controlled by remote unit processor 34, also includes a mixer (not shown). Processor 34 can thus cause audio interface 98 to mix the output of the selected microphone with the output of recording means 30, which processor 34 causes to play as described above. Similarly, in response to a "PLAY_MIXED_AUDIO" command, central control unit 16 mixes live audio with any audio previously stored in recording means 96. Audio interface 94 also includes a mixer (not shown) and performs the mixing function under the control of processor 34.

Obviously, other embodiments and modifications of the present invention will occur readily to those of ordinary skill in the art in view of these teachings. Therefore, this invention is to be limited only by the following claims, which include all such other embodiments and modifications when viewed in conjunction with the above specification and accompanying drawings.

I claim:

1. A security system for monitoring a premises from a monitoring center at a remote location, comprising:

at least one sensor for detecting the occurrence of an event at said premises;

at least one microphone at said premises, said microphone producing a live audio signal;

local recording means for recording an audio signal corresponding to said live audio signal;

detector means at said premises for receiving said live audio signal from said microphone, for detecting the occurrence of a sound in said live audio signal, and for producing an indication of said occurrence of said sound;

a local control unit at said premises for establishing a communication link with said monitoring center in response to said detection of the occurrence of an event, for transmitting said indication of said occurrence of said sound to said monitoring center, and for transmitting an audio signal produced by a selected audio source;

a central control unit at said monitoring center for communicating with said local control unit over said established communication link, for receiving said indication of said occurrence of said event, and for receiving said indication of said occurrence of said sound;

indication means at said monitoring center connected to said central control unit for providing a perceptible indication of said occurrence of said sound;

source selection means at said monitoring center connected to said central control unit for selecting an audio source from a group comprising said at least one microphone and said local recording means; and a speaker at said monitoring center connected to said central control unit for reproducing sound from said selected audio source.

2. The security system described in claim 1, wherein:

said central control unit transmits source selection commands to said local control unit in response to said source selection means; and said speaker produces sound from said audio source corresponding to said source selection commands.

3. The security system described in claim 2, wherein said local control unit transmits said live audio signal immediately after said communication link is established.

4. The security system described in claim 2, wherein said local control unit transmits said stored audio signal in response to a first source selection command.

5. The security system described in claim 2, wherein said local control unit transmits said stored audio signal in response to a second source selection command and transmits said live audio signal instead of said stored audio signal when said detector means detects the occurrence of a sound.

6. The security system described in claim 2, wherein said local control unit transmits a mixture of both said live audio signal and said recorded audio signal in response to a third source selection command.

7. The security system described in claim 1, wherein said local control unit further comprises:

memory means for storing a sound map; and processor means for determining an index representing the starting location of a sound recorded on said local recording means, and said sound map includes said index.

8. The security system described in claim 7, wherein said local control unit transmits said sound map to said monitoring center.

9. The security system described in claim 8, wherein said local control unit further comprises:

duration measuring means for measuring a duration of said sound; and said sound map includes said duration.

10. The security system described in claim 8, wherein said local control unit further comprises:

quantization means determining an average amplitude of said sound; and said sound map includes said average amplitude.

11. The security system described in claim 8, wherein said central control unit displays a graphical representation of at least one said sound.

12. The security system described in claim 11, wherein said indication means comprises a video monitor.

13. The security system described in claim 12, wherein said graphical representation is a waveform wherein said sounds are represented by pulses, each having a length equal to said duration of said represented sound and a height equal to said average amplitude of said represented sound.

14. A method for monitoring a premises from a monitoring center at a remote location, comprising the steps of:

detecting the occurrence of an event at said premises;

producing a live audio signal at said premises;

recording an audio signal at said premises corresponding to said live audio signal;

producing an indication of an occurrence of a sound;

establishing a communication link between said premises and said monitoring center in response to said detection of the occurrence of an event;

transmitting said indication of said occurrence of said sound to said monitoring center; and providing a perceptible indication at said monitoring center in response to receipt of said indication of said occurrence of said sound.

15. The method described in claim 14, further comprising the step of selecting an audio source at said monitoring center.

16. The method described in claim 15, further comprising the step of transmitting an audio signal corresponding to said selected audio source from said local control unit to said monitoring center.

17. The method described in claim 15, further comprising the step of transmitting said live audio signal immediately after said communication link is established.

18. The method described in claim 15, further comprising the step transmitting said live audio signal in response to a first command.

19. The method described in claim 15, further comprising the step of transmitting said stored audio signal in response to a second command.

20. The method described in claim 15, further comprising the step of transmitting said stored audio signal and transmitting said live audio signal instead of said stored audio signal upon detecting the occurrence of a sound, said step occurring in response to a third command.

21. The method described in claim 15, further comprising the step of transmitting a mixture of both said live audio signal and said recorded audio signal in response to a fourth command.

22. A method for monitoring a premises from a monitoring center at a remote location, comprising the steps of:

detecting the occurrence of an event at said premises;

producing a live audio signal at said premises;

recording an audio signal at said premises corresponding to said live audio signal;

producing an indication of an occurrence of a sound;

establishing a communication link between said premises and said monitoring center in response to said detection of the occurrence of an event;

transmitting said indication of said occurrence of said sound to said monitoring center;

providing a perceptible indication at said monitoring center in response to receipt of said indication of said occurrence of said sound;

selecting an audio source at said monitoring center;

transmitting an audio signal corresponding to said selected audio source from said local control unit to said monitoring center;

transmitting said live audio signal immediately after said communication link is established;

transmitting said live audio signal in response to a first command;

transmitting said stored audio signal in response to a second command;

transmitting said stored audio signal and transmitting said live audio signal instead of said stored audio signal upon detecting the occurrence of a sound, said step occurring in response to a third command; and transmitting a mixture of both said live audio signal and said recorded audio signal in response to a fourth command.

* * * * *